US006024278A

United States Patent [19]

Martin

[11] Patent Number: 6,024,278

[45] Date of Patent: Feb. 15, 2000

[54] MAILABLE ADVERTISING MATERIALS

[75] Inventor: John J. Martin, Louisville, Ky.

[73] Assignee: Crane Productions, Inc., Louisville, Ky.

[21] Appl. No.: 09/219,209

[22] Filed: Dec. 22, 1998

[51] Int. Cl.[7] ..... B65D 27/04; B65D 27/22

[52] U.S. Cl. ..... 229/92.8; 229/71; 229/84; 40/600; 40/711; 40/776

[58] Field of Search ..... 229/92.8, 71, 84; 40/600, 711, 776

[56] References Cited

U.S. PATENT DOCUMENTS

| | | | |
|---|---|---|---|
| 2,782,542 | 2/1957 | Blevens | 229/84 X |
| 4,244,511 | 1/1981 | Coleman | 229/92.3 |
| 5,261,174 | 11/1993 | Blegen | 40/600 |
| 5,303,489 | 4/1994 | Blegen | 40/600 |
| 5,458,282 | 10/1995 | Martin | 229/92.8 |
| 5,641,116 | 6/1997 | Martin | 229/92.8 |
| 5,676,307 | 10/1997 | Martin | 229/92.8 |
| 5,699,956 | 12/1997 | Brennan | 229/92.8 |
| 5,868,498 | 2/1999 | Martin | 40/600 |
| 5,918,400 | 7/1999 | Schonberger | 40/711 |
| 5,924,624 | 7/1999 | Martin | 229/71 |

*Primary Examiner*—Jes F. Pascua
*Attorney, Agent, or Firm*—James C. Eaves, Jr.; Greenbaum Doll & McDonald PLLC

[57] ABSTRACT

A mailable advertising article includes a planar blank having first and second planar surfaces, and first and second fold lines dividing the planar blank into a back wall portion, a protective flap adjacent the back wall portion along the first fold line, and a pocket-forming flap adjacent the back wall portion along the second fold line. A magnetic sheet is affixed to the second planar surface of the back wall portion. The pocket-forming flap is foldable about the second fold line over the back wall portion and is affixable thereto at at least one preselected location thereon, thereby forming a pocket between the back wall portion and the pocket-forming flap. The protective flap is foldable about the first fold line over the pocket-forming flap and is affixable thereto at at least one preselected location thereon. The second planar surface of the magnetic sheet includes mailing information printed thereon.

15 Claims, 14 Drawing Sheets

MAILABLE ADVERTISING MATERIALS

BACKGROUND OF THE INVENTION

1. Technical Field of the Invention

The present invention relates to advertising materials which are mailable directly to consumers. More particularly, the present invention relates to a mailable article containing advertising materials therein, wherein the mailable article is provided with means, such as, for example, a flexible sheet of magnetic material, to permit the consumer's displaying of the article, such as, for example, from the consumer's household refrigerator.

2. Description of the Related Art

Restaurants and other businesses oftentimes deliver advertising materials directly to the homes of their consumers. For example, a foldable advertising article may contain information relating to the mailing address of a consumer's home and thereby be sent directly to the consumer via the United States Postal Service ("USPS"), whereby the consumer receives the advertising article along with the consumer's regular mail. The advertising article may contain one or more coupons therein, which, in addition to information relating to the identity of the restaurant or other business, such as telephone numbers, business locations or the like, may serve as a continuing source of advertising while in the consumer's home. For this reason, restaurants or other businesses sending direct by-mail advertising articles may provide means thereon for affixing the advertising article to a commonly-viewed area of the consumer's home.

For example, U.S. Pat. Nos. 5,458,282, 5,676,307 and 5,641,116, all to Martin, each teach an advertising article having a magnet secured to one surface thereof for affixing the advertising article to a surface, such as a refrigerator, in the consumer's home.

SUMMARY OF THE INVENTION

The present invention is for a mailable advertising article, and more particularly, to a mailable article containing advertising materials therein, wherein the mailable article is provided with means, such as, for example, a flexible sheet of magnetic material, to permit the consumer's displaying of the article, such as, for example, from the consumer's household refrigerator.

The mailable advertising article includes a foldable planar blank and a magnetic sheet adhesively affixed to one planar surface of the planar blank to permit displaying of the planar blank from the consumer's refrigerator. Mailing information is printed on an exposed surface of the magnetic sheet, thereby permitting mailing of the advertising article via the USPS. The planar blank is preferably foldable into an orientation suitable for enclosing one or more inserts, for example, coupons, therein. Information, such as customized advertising information or personalized greeting information may be printed on the planar blank and displayable therefrom once the article is affixed to the consumer's refrigerator.

A mailable advertising article according to a preferred embodiment of the present invention includes a planar blank having first and second planar surfaces, and first and second fold lines dividing the planar blank into a back wall portion, a protective flap adjacent the back wall portion along the first fold line, and a pocket-forming flap adjacent the back wall portion along the second fold line. A magnetic sheet is affixed to the second planar surface of the back wall portion. The pocket-forming flap is foldable about the second fold line over the back wall portion and is affixable thereto at at least one preselected location thereon, thereby forming a pocket between the back wall portion and the pocket-forming flap. The protective flap is foldable about the first fold line over the pocket-forming flap and is affixable thereto at at least one preselected location thereon. The second planar surface of the magnetic sheet includes mailing information printed thereon.

BRIEF DESCRIPTION OF THE DRAWINGS

A better understanding of the present invention will be had upon reference to the following description in conjunction with the accompanying drawings in which like numerals refer to like parts, and wherein.

DETAILED DESCRIPTION OF THE PREFERRED EMBODIMENTS

Figure 1:
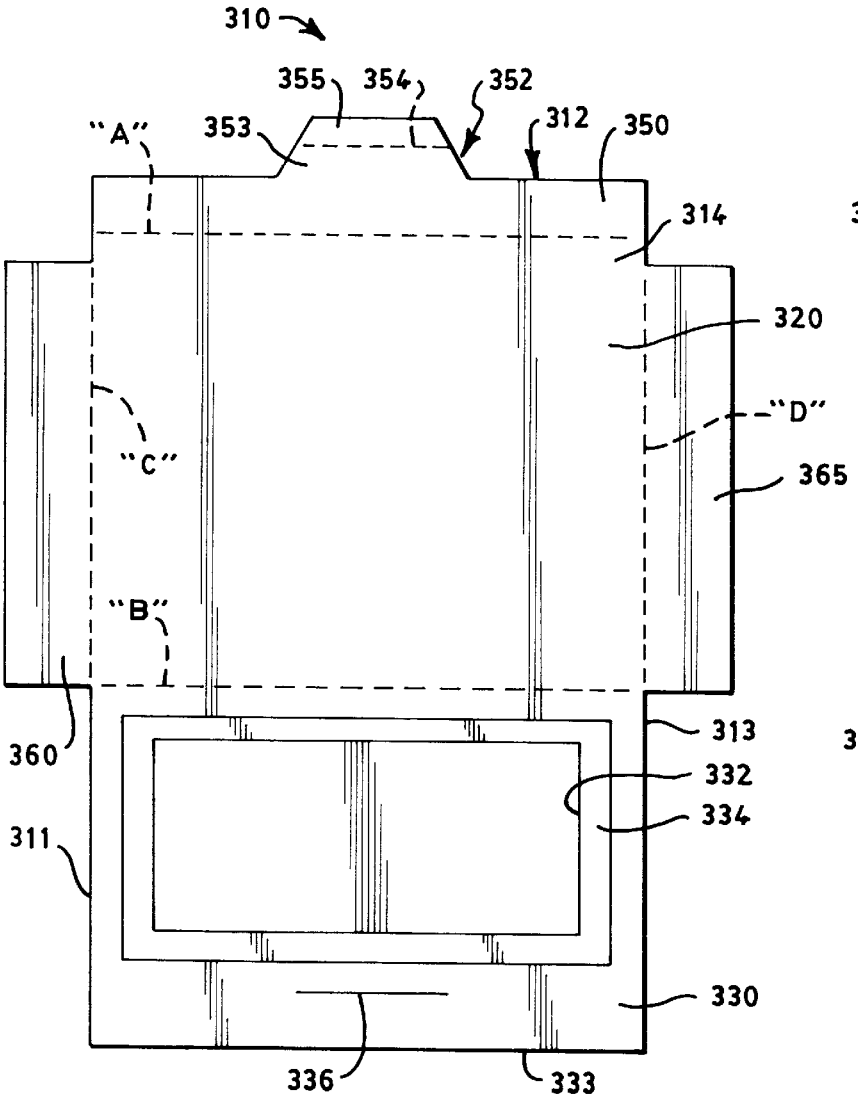
FIG. 1 is a front view of a planar blank being foldable to form a mailable advertising article according to another alternative embodiment of the present invention.
Figure 2:
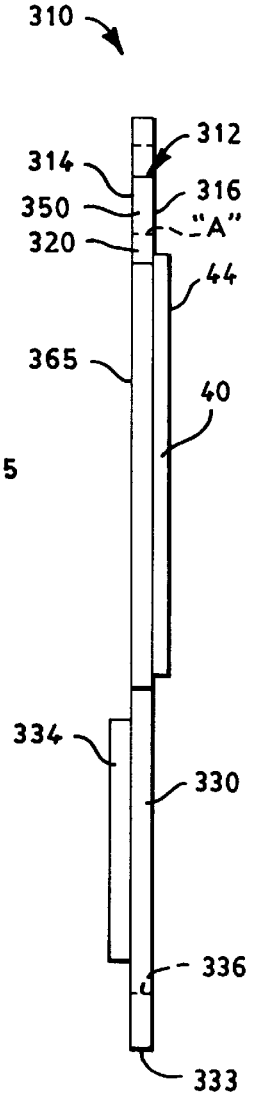
FIG. 2 is a side view of the planar blank of FIG. 1.

With reference to FIGS. 1 and 2, a mailable advertising article 310 according to a preferred embodiment of the present invention includes a planar blank 312 having a first planar surface 314 and a second planar surface 316 and is preferably constructed from paper, Bristol board, posterboard, plastic or the like, although any suitable material may be used therefor.

The planar blank 312 is divided by fold lines "A" and "B" into a back wall portion 320, a pocket-forming flap 330 being upwardly foldable about fold line "B" over the first planar surface of the back wall portion 320, and a protective flap 350 being downwardly foldable about the fold line "A" over the first planar surface 314 of the back wall portion 320 and over the second planar surface 316 of the upwardly-folded pocket-forming flap 330. A thin, flexible sheet of magnetic material 40 is adhesively secured to the second planar surface 316 of the back wall portion 320.

Figure 7:
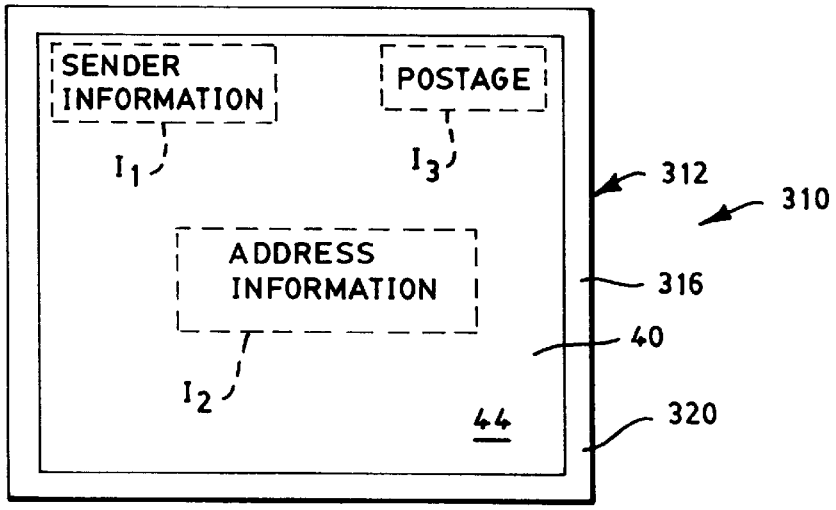
FIG. 7 is a rear view of the completely-folded planar blank of FIG. 5.
Figure 8:
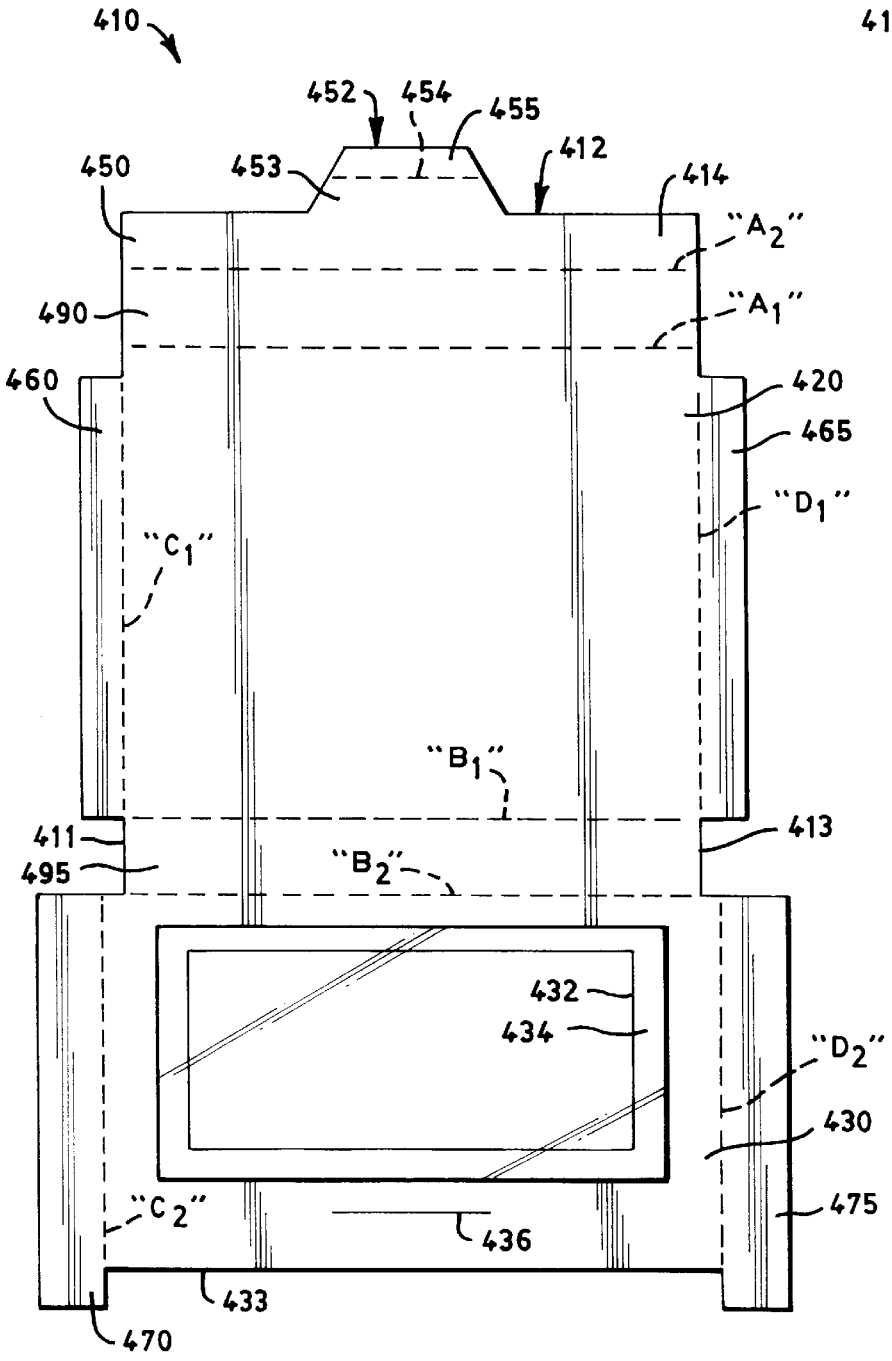
FIG. 8 is a front view of a planar blank being foldable to form a mailable advertising article according to another alternative embodiment of the present invention.
Figure 9:
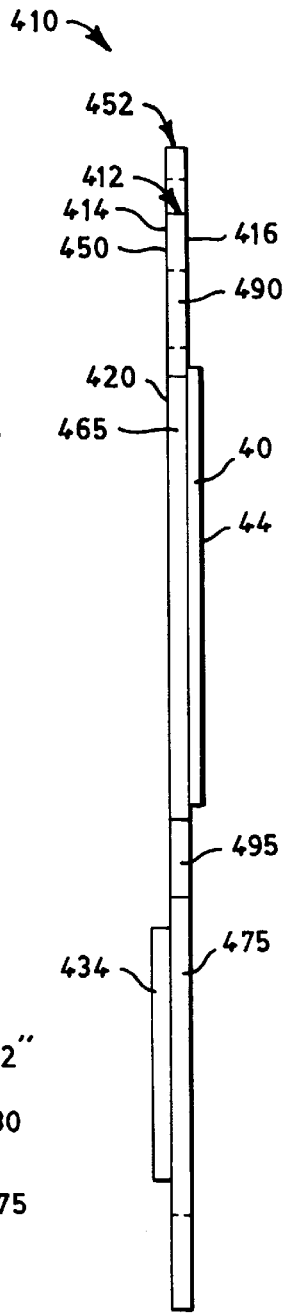
FIG. 9 is a side view of the planar blank of FIG. 8.

With additional reference to FIG. 7, a second planar surface 44 of the magnetic sheet 40 is provided with one or more regions $I_1$, $I_2$, $I_3$ within which mailing information is printed or is otherwise provided. For example, a first region $I_1$ contains information relating to the identity and mailing address of the sender; a second region $I_2$ contains information relating to the identity and mailing address of the recipient; and, a third region $I_3$ contains pre-printed postage or a stamp. Additional regions may be provided in other locations on the second planar surface 44 of the magnetic sheet 40 for other information, such as, for example, a bar-code.

An opening 332 is provided through the pocket-forming flap 330 and is covered on one side thereof with a thin, transparent film 334, such as, for example, polyethylene. The film 334 is adhesively secured to the first planar surface 314 of the pocket-forming flap 330 immediately outward of the opening 332. A slit 336 is provided through the pocket-forming flap 330 near an outermost end 333 thereof and centered between first and second longitudinal edges 311, 313, respectively, of the planar blank 312.

Side flaps 360, 365 form an integral construction with the back wall portion 320 of the planar blank 312 and project transversely outwardly therefrom. The side flaps 360, 365 are coplanar with the planar blank 312 and are inwardly foldable over fold lines "C" and "D", respectively. Fold lines "C", "D" are substantially transverse to fold lines "A", "B" and are preferably collinear with first and second side edges 311, 313, respectively, of the planar blank 312.

Figure 3:
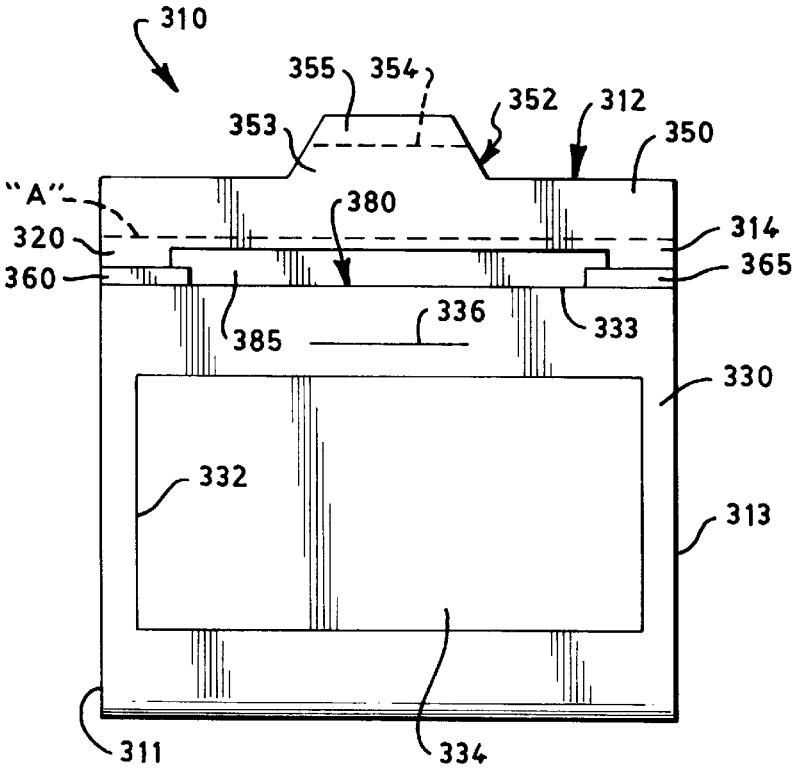
FIG. 3 is a front view of the planar blank of FIG. 1, shown partially folded to define a pocket for receiving advertising materials therein.
Figure 4:
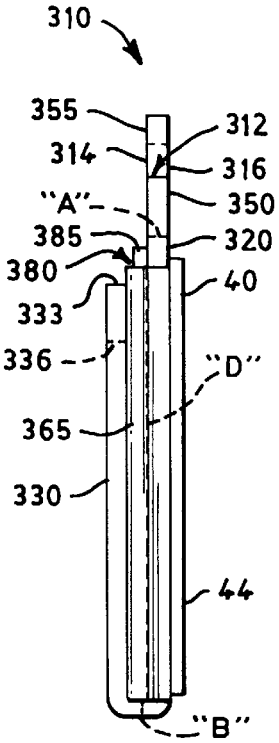
FIG. 4 is a side view of the partially-folded planar blank of FIG. 3.

With reference to FIGS. 3 and 4, the planar blank 312 is foldable into the mailable advertising article 310 about fold lines "B", "C" and "D" to form a pocket 380 defined by the back wall portion 320, the first and second side flaps 360, 365, respectively, and the pocket-forming flap 330. The pocket 380 is sized to receive at least one insert 385 therein, such as, for example, a coupon, letter, card, certificate, photograph or the like, which is viewable through the opening 332. More particularly, the pocket 380 is formed by folding the first and second side flaps 360, 365, respectively, inwardly about fold lines "C" and "D", respectively, and over the first planar surface 314 of the back wall portion 320. The pocket-forming flap 330 is folded upwardly about fold line "B", over the first planar surface 314 of the back wall portion 320, and over each respective second planar surface 316 of the inwardly-folded side flaps 360, 365, to which the first planar surface 314 of the upwardly-folded pocket-forming flap 330 is adhesively secured thereto at at least one location thereon. Alternatively, instead of side flaps 360, 365, the first planar surface 314 of the upwardly-folded pocket-forming flap 330 may be adhesively secured directly to the first planar surface 314 of the back wall portion 320 along the side edges 311, 313 thereof.

Figure 5:
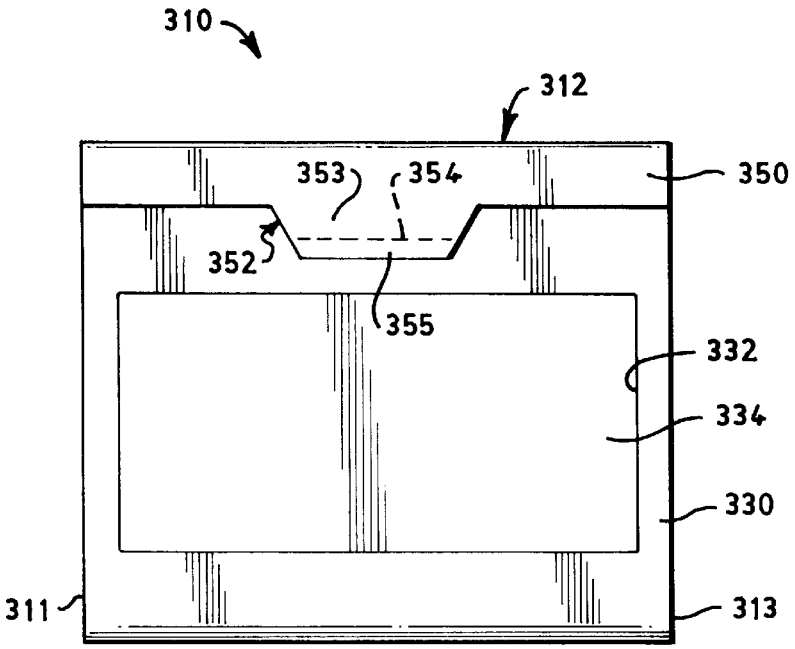
FIG. 5 is a front view of the planar blank of FIG. 1, shown completely folded to define the mailable advertising article.
Figure 6:
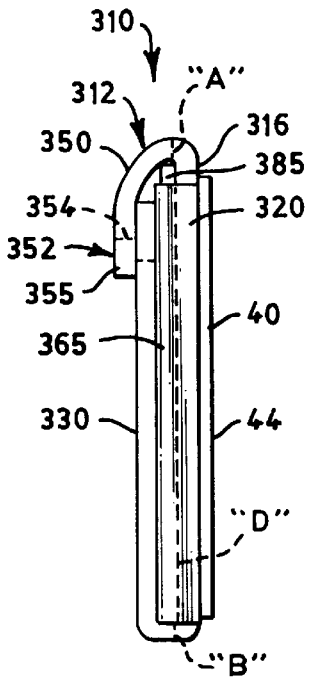
FIG. 6 is a side view of the completely-folded planar blank of FIG. 5.

With additional reference to FIGS. 5 and 6, the mailable advertising article 310 is folded into an orientation suitable for mailing as a first-class mail item with the USPS. More particularly, the protective flap 350 is folded downwardly about fold line "A", over the first planar surface 314 of the back wall portion 320 and over the second planar surface 316 of the upwardly-folded pocket-forming flap 330, thereby enclosing the at least one insert 385 therein.

The protective flap 350 includes a tab portion 352 being substantially centered between the first and second side edges 311, 313, respectively, of the planar blank 312, and having a perforation line 354 thereacross, thereby defining a hold-down portion 355 and a free portion 353 of the tab 352. The first planar surface 314 of the hold-down portion 355 of the protective flap tab 352 is adhesively secured to the second planar surface 316 of the upwardly-folded pocket-forming flap 330, by a line of adhesive (not shown), extending transversely thereacross.

To expose the pocket 380, for example, when an individual wishes to gain access to the at least one insert 385 therein, the individual grasps the protective flap 350, towards one side edge 311, 313 of the planar blank 312, and pulls the protective flap 350 upwardly away from the pocket-forming flap 330, to which the hold-down portion 355 of the protective flap tab 352 has been adhesively secured as described herein. The protective flap 350 is pulled with sufficient force to tear the tab 352 along the perforation line 354, thereby separating the free portion 353 of the tab 352 from the hold-down portion 355 thereof, which remains secured to the pocket-forming flap 330. Lifting the protective flap 350 away from the pocket-forming flap 330, then, exposes the pocket 380, the at least one insert 385 held therein and the slit 336. The pocket 380 and the at least one insert 385 therein may be repeatedly enclosed within the article 310 by closing the protective flap 350 and inserting the free portion 353 of the tab 352 into the slit 336, which has been sized and positioned to receive the free end 353 of the tab 352 and to affix the protective flap 350 to the pocket-forming flap 330.

Either prior to, or after, opening of the article 310 as herein described, the article 310 may be magnetically secured to a magnetic surface, such as, for example, a mailbox, refrigerator, office desk, filing cabinet or the like, to display the foremost insert 385 disposed therein through the opening 332. After the article 310 has been opened, one or more of the at least one insert 385 may be removed and/or replaced within the pocket 380 and stored and displayed therefrom. Moreover, another item, such as a photograph, may be inserted into the pocket 380 and displayed by the article 310 from the magnetic surface. As such, the second planar surface 316 of the pocket-forming flap 330 may contain graphics or other indicia printed thereon, alongside the opening 332 to present the appearance of a picture frame, or the like.

With reference to FIGS. 8, 9, 15 and 16, a mailable advertising article 410 according to an alternative embodiment of the present invention includes many components in common with the mailable advertising article according to the preferred embodiment hereof and like reference numerals are intended to represent like components. However, the article 410 according to the present embodiment is constructed of heavy-weight paper, Bristol board or cardboard and is foldable into substantially the shape of an upright box.

Figure 14:
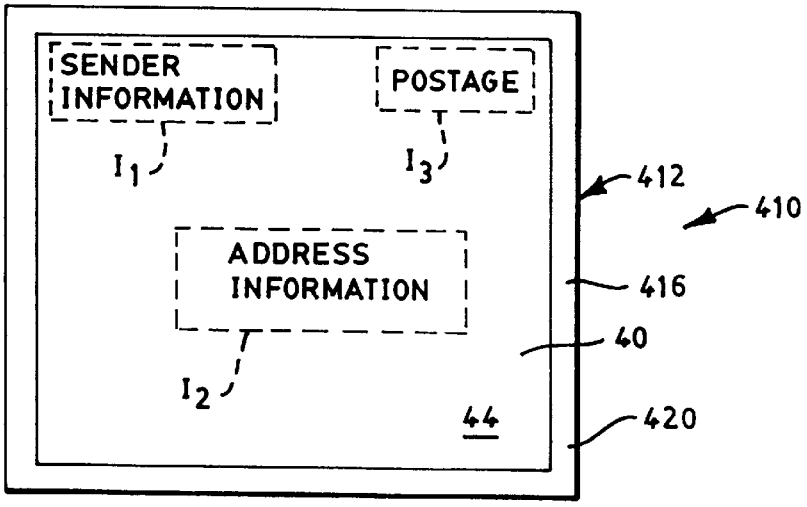
FIG. 14 is a rear view of the completely-folded planar blank of FIG. 12.
Figure 16:
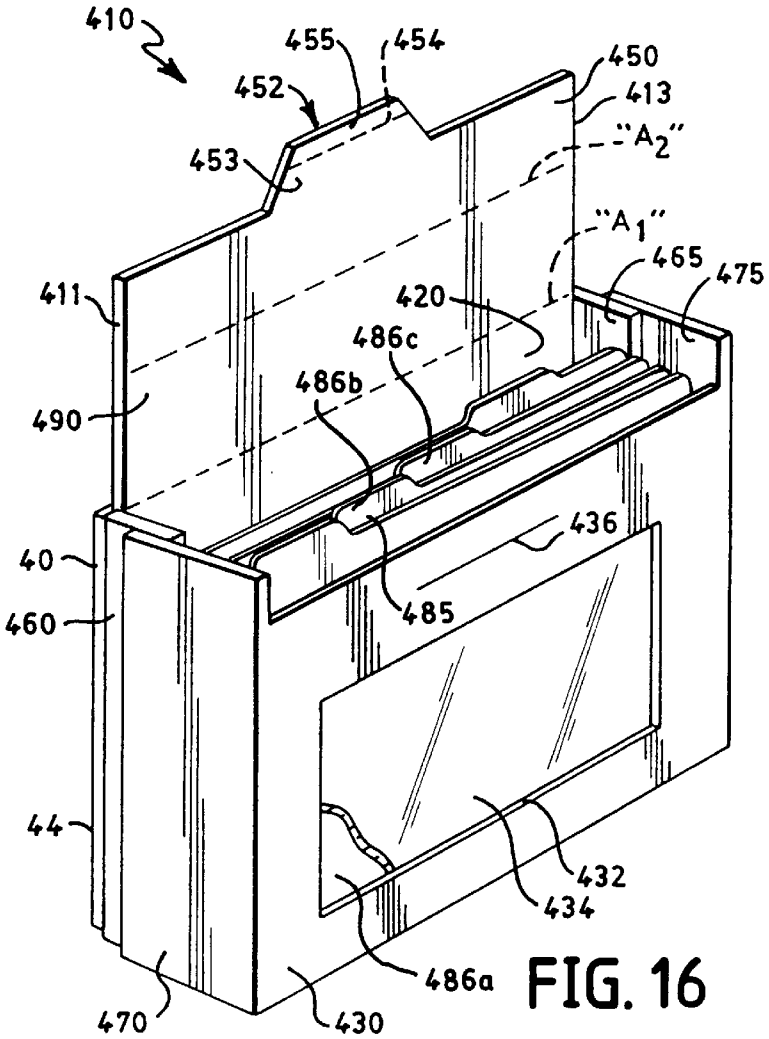
FIG. 16 is a perspective view of the partially-folded planar blank of FIG. 10, shown with a plurality of insert dividers therein.
Figure 15:
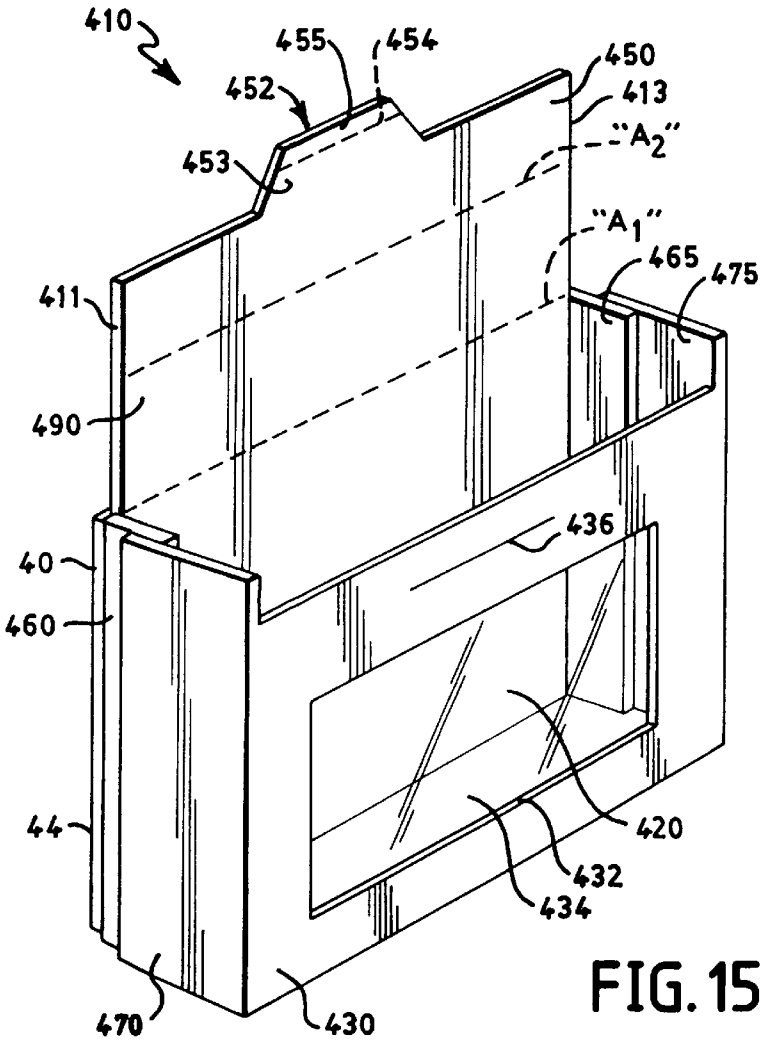
FIG. 15 is a perspective view of the partially-folded planar blank of FIG. 10, shown empty.
Figure 17:
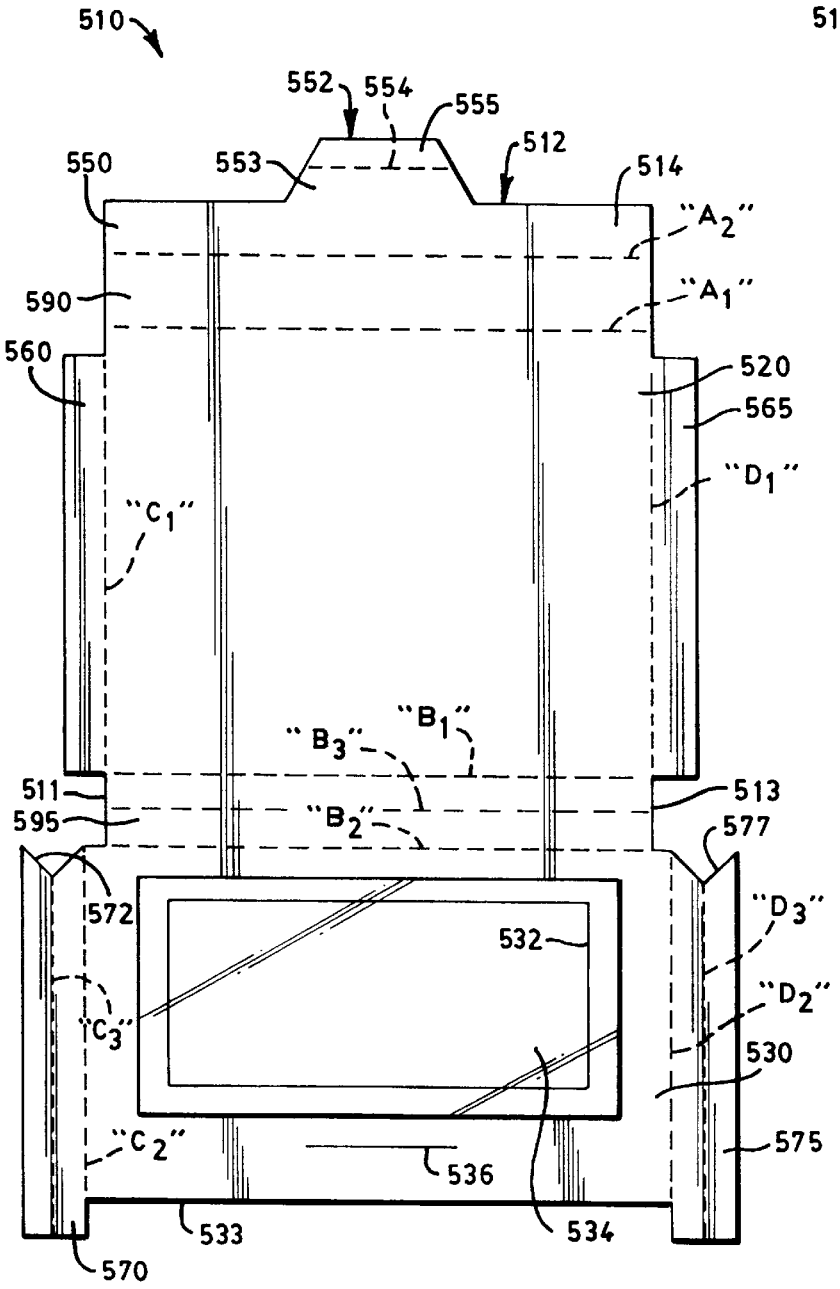
FIG. 17 is a front view of a planar blank being foldable to form a mailable advertising article according to another alternative embodiment of the present invention.
Figure 18:
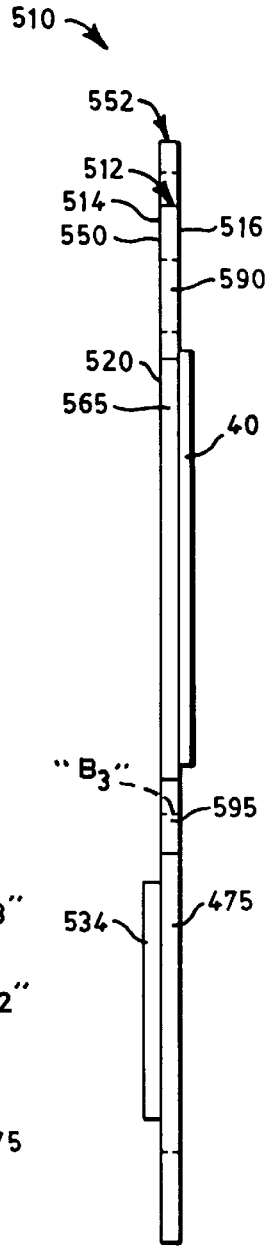
FIG. 18 is a side view of the planar blank of FIG. 17.

Particularly, the article 410 according to the present embodiment includes a planar blank 412 having a first planar surface 414 and a second planar surface 416. The planar blank 412 is divided by substantially parallel fold lines "$A_1$", "$A_2$", "$B_1$" and "$B_2$" into a back wall portion 420, a top portion 490, a bottom portion 495 a front wall portion 430, and a protective flap 450. The top portion 490 and the bottom portion 495 are each foldable about fold lines "$A_1$" and "$B_1$", respectively, to be substantially forewardly-perpendicular to the back wall portion 420. The front wall potion 430 is foldable about fold line "$B_2$" to be substantially upwardly perpendicular to the bottom portion 495 and to be spaced forewardly from the back wall portion 420. The protective flap 450 is foldable about fold line "$A_2$" to be substantially downwardly perpendicular to the top portion 490 and to be spaced forewardly from the back wall portion 420. The first planar surface 414 of the downwardly-folded protective flap 450 is adhesively securable to the second planar surface 416 of the upwardly-folded front wall portion 430. A thin, flexible sheet of magnetic material 40 is adhesively secured to the second planar surface 416 of the back wall portion 420. The second planar surface 44 (FIG. 14) of the magnetic sheet 40 is provided with regions $I_1$, $I_2$, $I_3$ having mailing information provided thereon, such as for example, according to the preferred embodiment hereof.

An opening 432 is provided through the front wall portion 430 and is covered on one side thereof with a thin, transparent film 434, such as, for example, polyethylene. The film 434 is adhesively secured to the first planar surface 414 of the front wall portion 430 immediately outward of the opening 432. A slit 436 is provided through the front wall portion 430 near an outermost end 433 thereof and centered between first and second longitudinal edges 411, 413, respectively, of the planar blank 412.

Back side flaps 460, 465 form an integral construction with the back wall portion 420 of the planar blank 412 and project transversely outwardly therefrom. The back side flaps 460, 465 are coplanar with the planar blank 412 and are inwardly foldable over fold lines "$C_1$" and "$D_1$", respectively, to be substantially forewardly-perpendicular to the back wall portion 420. Fold lines "$C_1$, $D_1$" are substantially transverse to fold lines "$A_1$", "$A_2$", "$B_1$""$B_2$" and are preferably collinear with first and second side edges 411, 413, respectively, of the planar blank 412.

Front side flaps 470, 475 form an integral construction with the front-wall portion 430 of the planar blank 412 and project transversely outwardly therefrom. The front side flaps 470, 475 are coplanar with the planar blank 412 and are inwardly foldable over fold lines "$C_2$" and "$D_2$", respectively, to be substantially forewardly-perpendicular to the front wall portion 430 and to overlap the forewardly-folded back side flaps 460, 465, respectively. The first planar surface 414 of each front side flap 470, 475 is adhesively securable to the second planar surface 416 of its respective back side flap 460, 465.

Figure 10:
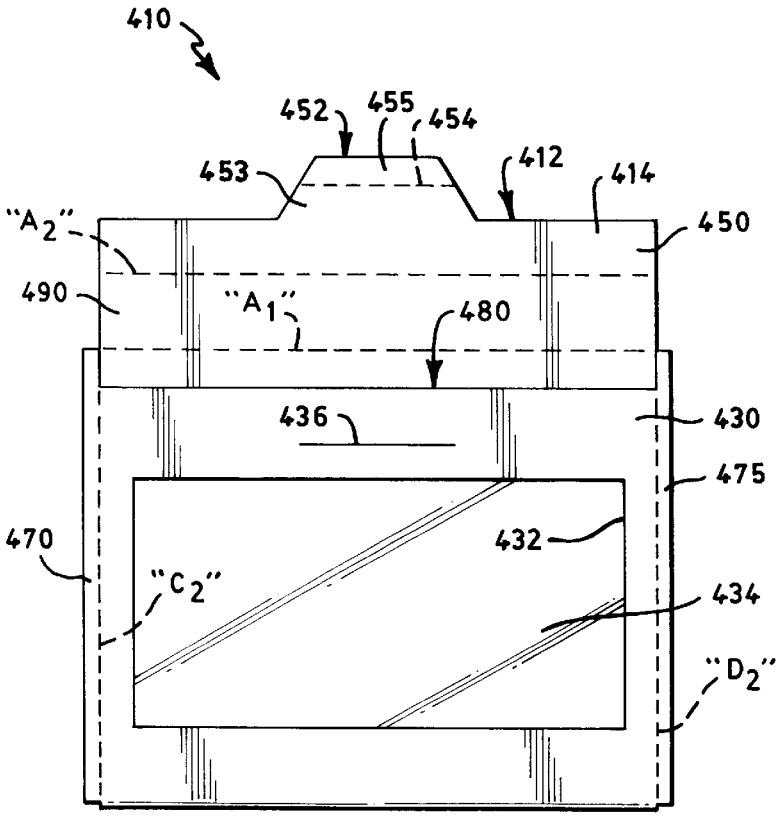
FIG. 10 is a front view of the planar blank of FIG. 8, shown partially folded to define a pocket for receiving advertising materials therein.
Figure 11:
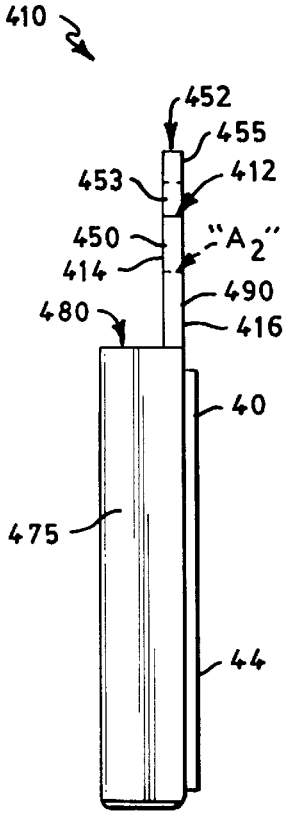
FIG. 11 is a side view of the planar blank of FIG. 10.

With additional reference to FIGS. 10 and 11, the planar blank 412 is foldable into the mailable advertising article 410 about fold lines "$A_1$", "$A_2$", "$B_1$", "$B_2$", "$C_1$""$D_1$", "$C_2$", "$D_2$" to form a pocket 480 defined by the back wall portion 420, the front wall portion 430, the top portion 490, the bottom portion 495, the front side flaps 460, 465, and the back side flaps 470, 475. The pocket 480 is sized to receive at least one insert 485 therein, such as, for example, a coupon, letter, card, certificate, photograph or the like, which is viewable through the opening 432. Preferably, the pocket 480 is sized to receive a plurality of inserts 485 therein, and may contain one or more insert dividers 486*a*,. 486*b*, 486*c* therein to permit categorizing the inserts 485 according to type. For example, if a plurality of coupon inserts 485 are provided, then one insert divider 486*a* may be provided for coupons relating to food articles, a second insert divider 486*b* may be provided for coupons relating to household supplies, a third insert divider 486*c* may be provided for coupons relating to children's items, and so on. Each insert divider 486*a*, 486*b*, 486*c* may have a tabbed portion thereof to permit quick-access to coupons of a desired category.

More particularly, the pocket 480 is formed by folding the bottom portion 495 (and the front wall portion 430, which is substantially coplanar with the bottom portion 495) forewardly about fold line "$B_1$" so that the bottom portion 495 is substantially perpendicular to the back wall portion 420. The front wall portion 430 is folded upwardly about fold line "$B_2$" so that the front wall portion 430 is substantially parallel to the bottom portion 495, is spaced forewardly from the back wall portion 420 and is substantially parallel thereto, thereby defining a substantially "U"-shaped article, when viewed from the side. The back side flaps 460, 465 are each folded forewardly about fold lines "$C_1$", "$D_1$", respectively, towards the front wall portion 430, but not more than half-way theretowards, so that the back side flaps 460, 465 are each perpendicular to the back wall portion 420. The front side flaps 470, 475 are each folded rearwardly about fold lines "$C_2$", "$D_2$", respectively, towards the back wall portion 420, and overlapping the back side flaps 460, 465, so that each front side flap 470, 475 is perpendicular to the front wall portion 430. The front planar surface 414 of each front side flap 470, 475 is adhesively affixable to the second planar surface 416 of its respective back side flap 460, 465.

Figure 12:
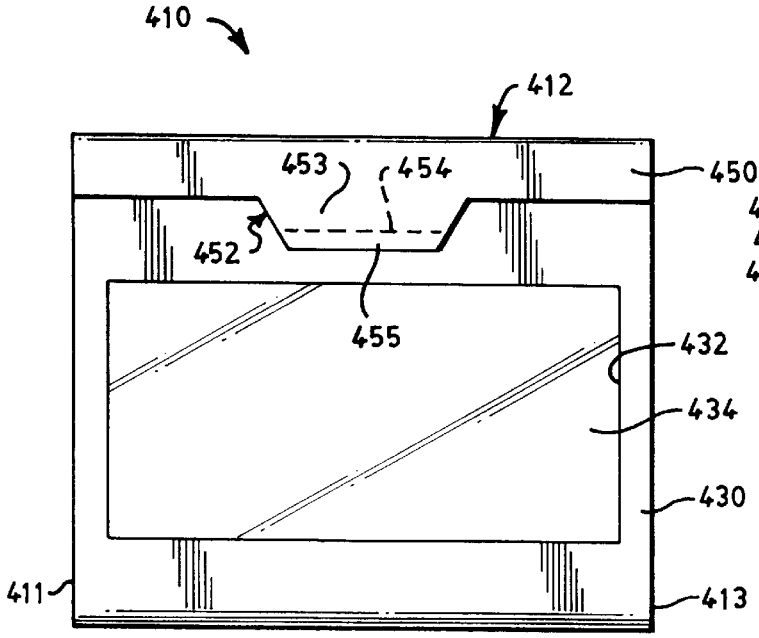
FIG. 12 is a front view of the planar blank of FIG. 8, shown completely folded to define the mailable advertising article.
Figure 13:
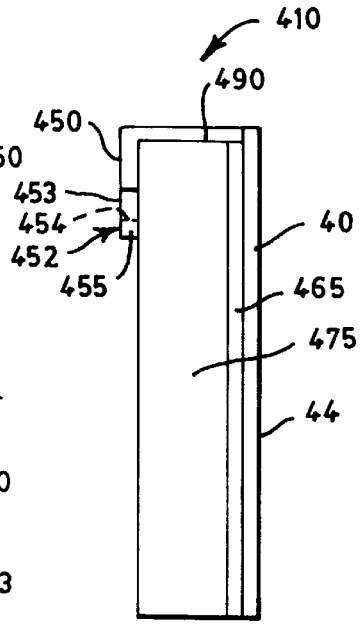
FIG. 13 is a side view of the completely-folded planar blank of FIG. 12.

With reference to FIGS. 12 and 13, the mailable advertising article 410 is folded into an orientation suitable for mailing as a first-class mail item with the USPS. More particularly, the top portion 490 (and the protective flap 450, which is substantially coplanar with the top portion 490) is folded forewardly about fold line "$A_1$" so that the top portion 490 is substantially perpendicular to the back wall portion 420, is spaced upwardly from the bottom portion 495 and is substantially parallel thereto. The protective flap 450 is folded downwardly about fold line "$A_2$" and over the second planar surface 416 of the front wall portion 430, thereby enclosing the at least one insert 495 and the one or more insert dividers 486 therein.

The protective flap 450 includes a tab portion 452 being substantially centered between the first and second side edges 411, 413, respectively, of the planar blank 412, and having a perforation line 454 thereacross, thereby defining a hold-down portion 455 and a free portion 453 of the tab 452. The first planar surface 414 of the hold-down portion 455 of the protective flap tab 452 is adhesively secured to the second planar surface 416 of the upwardly-folded front wall portion 430, by a line of adhesive (not shown), extending transversely thereacross.

To expose the pocket 480, for example, when an individual wishes to gain access to the at least one insert 485 therein, the individual grasps the protective flap 450, towards one side edge 411, 413 of the planar blank 412, and pulls the protective flap 450 upwardly away from the pocket-forming flap 430, to which the hold-down portion 455 of the protective flap tab 452 has been adhesively secured as described herein. The protective flap 450 is pulled with sufficient force to tear the tab 452 along the perforation line 454, thereby separating the free portion 453 of the tab 452 from the hold-down portion 455 thereof, which remains secured to the front wall portion 430. Lifting the protective flap 450 away from the pocket-forming flap 430, then, exposes the pocket 480, the at least one insert 485 held therein and the slit 436. The pocket 480 and the at least one insert 485 therein may be repeatedly concealed by closing the protective flap 450 and inserting the free portion 453 of the tab 452 into the slit 436, which has been sized and positioned to receive the free end 453 of the tab 452 and to affix the protective flap 450 to the front wall portion 430.

Either prior to, or after, opening of the article 410 as herein described, the article 410 may be magnetically secured to a magnetic surface, such as, for example, a mailbox, refrigerator, office desk, filing cabinet or the like, to display the foremost insert 485 disposed therein through the opening 432. After the article 410 has been opened, one or more of the at least one insert 485 may be removed and/or replaced within the pocket 480 and stored and displayed therefrom. Moreover, another item, such as a photograph, may be inserted into the pocket 480 and displayed by the article 410 from the magnetic surface. As such, the second planar surface 416 of the pocket-forming flap 430 may contain graphics or other indicia printed thereon, alongside the opening 432 to present the appearance of a picture frame, or the like.

With reference to FIGS. 17, 18, 24 and 25, a mailable advertising article 510 according to another alternative embodiment of the present invention includes many components in common with the mailable advertising article 410 according to the embodiment hereof shown in FIGS. 8–16 and like reference numerals are intended to represent like components. However, the article 510 according to the present embodiment is constructed of heavy-weight paper, Bristol board or cardboard and is foldable into substantially the shape of an upright collapsible box.

Figure 23:
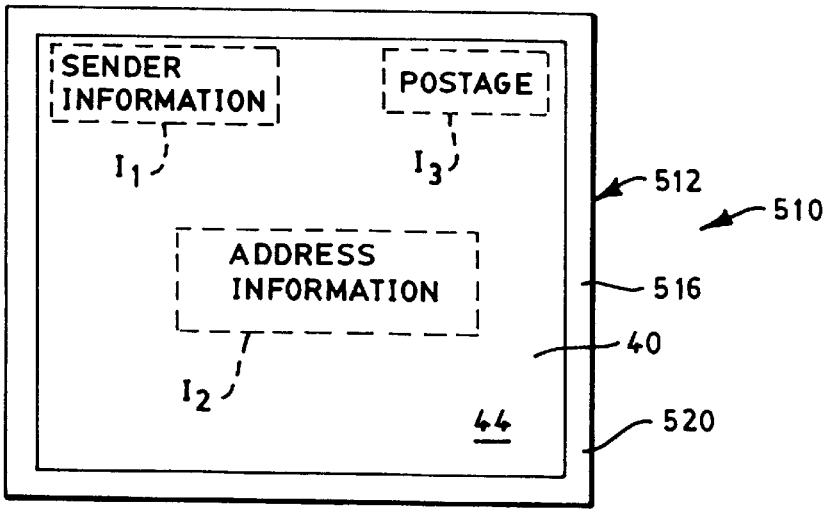
FIG. 23 is a rear view of the completely-folded planar blank of FIG. 17.
Figure 25:
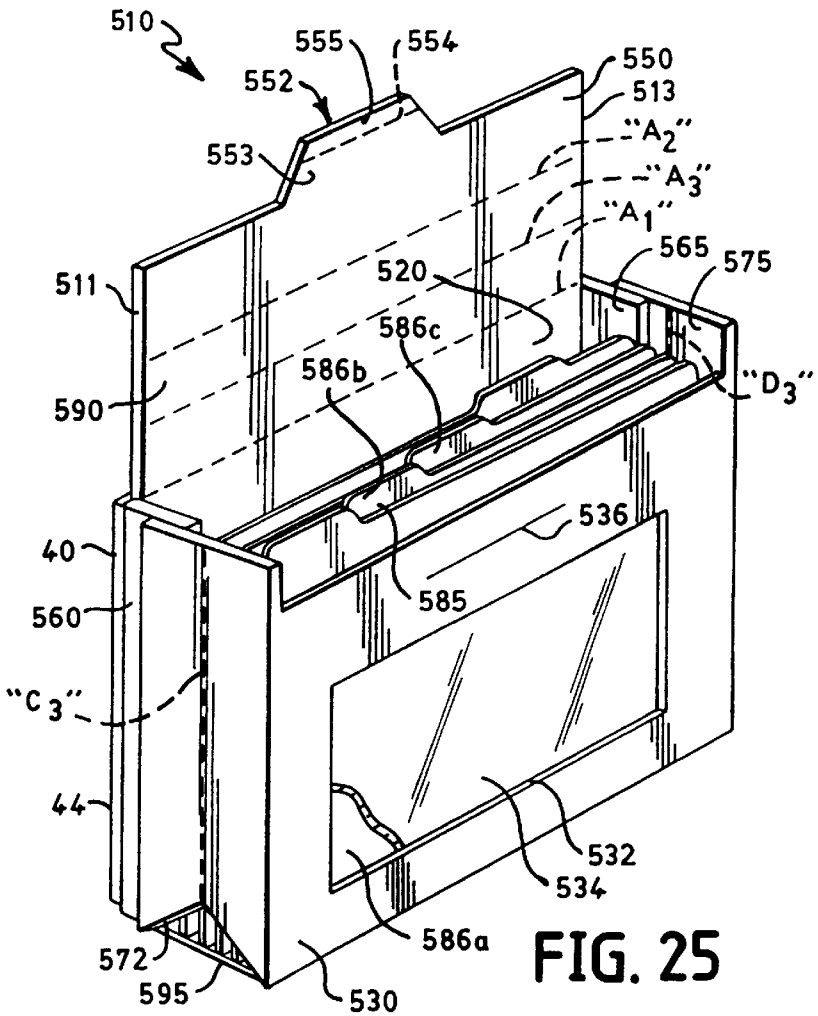
FIG. 25 is a perspective view of the partially-folded planar blank of FIG. 19, shown expanded with a plurality of insert dividers therein.
Figure 24:
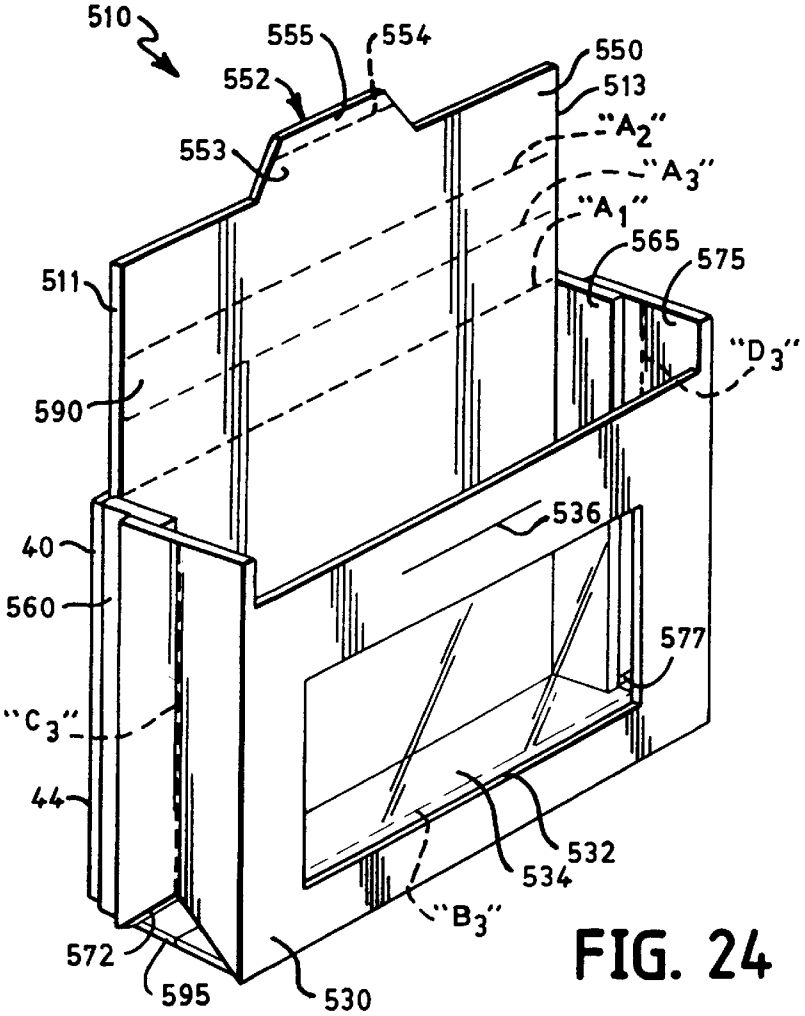
FIG. 24 is a perspective view of the partially-folded planar blank of FIG. 19, shown expanded and empty.
Figure 27:
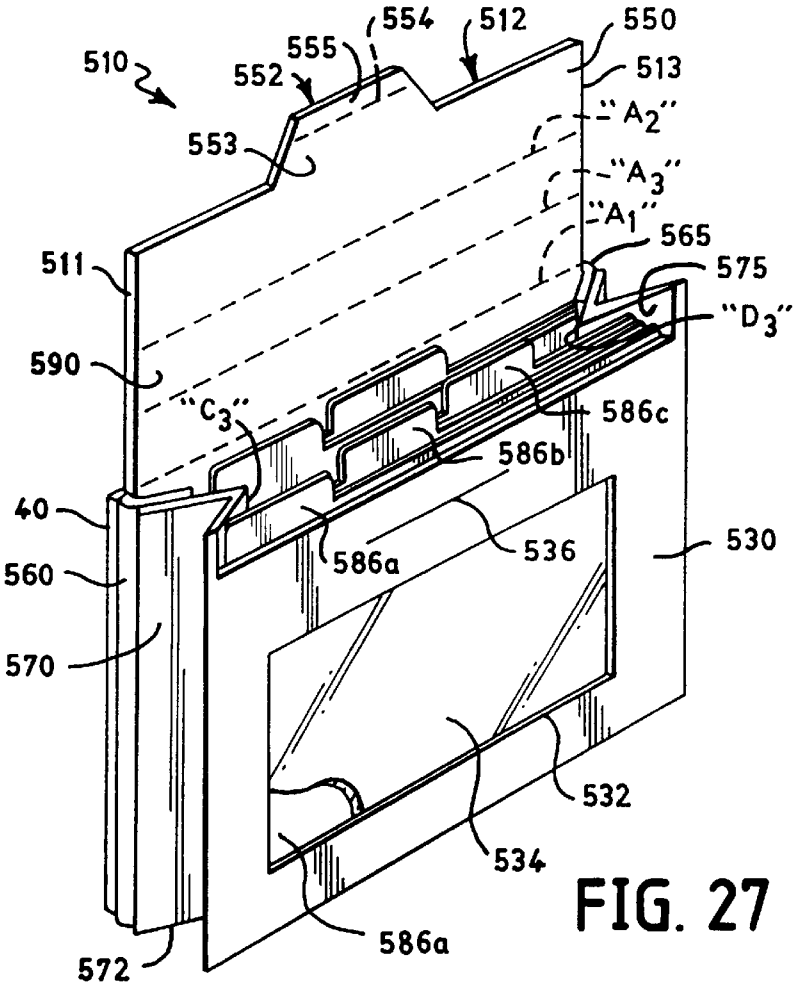
FIG. 27 is a perspective view of the partially-folded planar blank of FIG. 19, shown collapsed and with a plurality of insert dividers therein.
Figure 26:
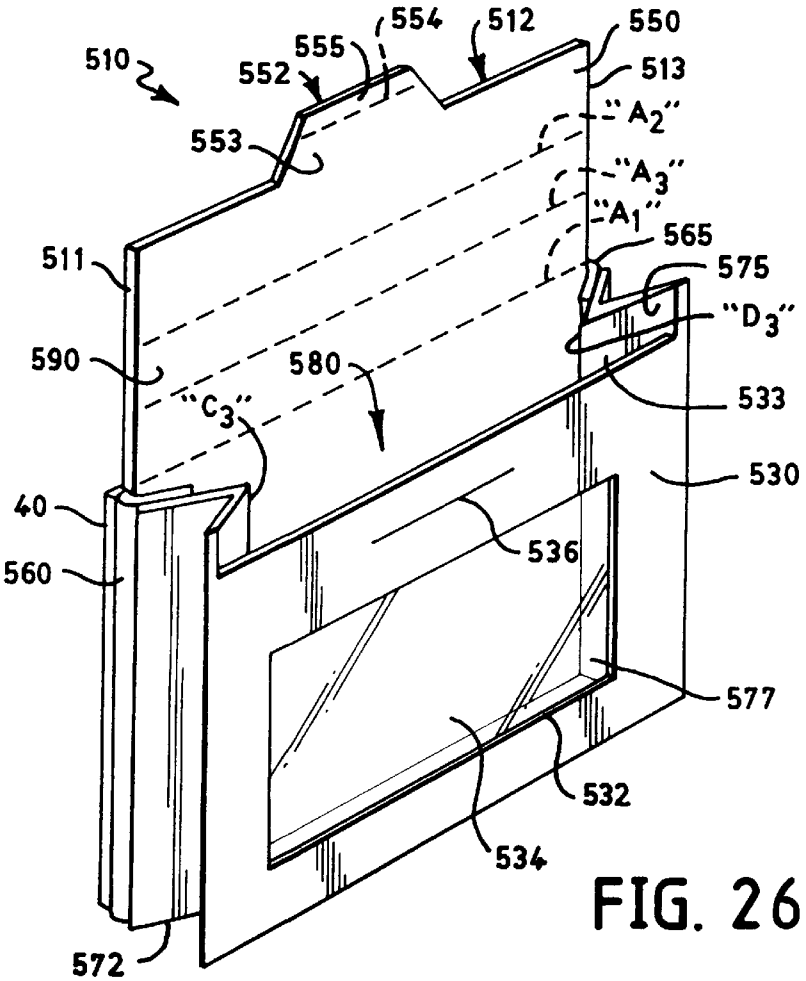
FIG. 26 is a perspective view of the partially-folded planar blank of FIG. 19, shown collapsed and empty.

Particularly, the article 510 according to the present embodiment includes a planar blank 512 having a first planar surface 514 and a second planar surface 516. The planar blank 512 is divided by substantially parallel fold lines "Al", "$A_2$", "$B_1$" and "$B_2$" into a back wall portion 520, a top portion 590, a bottom portion 595 a front wall portion 530, and a protective flap 550. The top portion 590 and the bottom portion 595 are each foldable about fold lines "$A_1$" and "$B_1$", respectively, to be substantially forewardly perpendicular to the back wall portion 520. The front wall potion 530 is foldable about fold line "$B_2$" to be substantially upwardly perpendicular to the bottom portion 595 and to be spaced forewardly from the back wall portion 520. The protective flap 550 is foldable about fold line "$A_2$" to be substantially downwardly perpendicular to the top portion 590 and to be spaced forewardly from the back wall portion 520. The first planar surface 514 of the downwardly-folded protective flap 550 is adhesively securable to the second planar surface 516 of the upwardly-folded front wall portion 530. A thin, flexible sheet of magnetic material 40 is adhesively secured to the second planar surface 516 of the back wall portion 520. The second planar surface 44 (FIG. 23) of the magnetic sheet 40 is provided with regions $I_1$, $I_2$, $I_3$ having mailing information provided thereon, such as for example, according to any embodiment hereof heretofore described.

An opening 532 is provided through the front wall portion 530 and is covered on one side thereof with a thin, transparent film 534, such as, for example, polyethylene. The film 534 is adhesively secured to the first planar surface 514 of the front wall portion 530 immediately outward of the opening 532. A slit 536 is provided through the front wall portion 530 near an outermost as end 533 thereof and centered between first and second longitudinal edges 511, 513, respectively, of the planar blank 512.

Back side flaps 560, 565 form an integral construction with the back wall portion 520 of the planar blank 512 and project transversely outwardly therefrom. The back side flaps 560, 565 are coplanar with the planar blank 512 and are inwardly foldable over fold lines "$C_1$" and "$D_1$", respectively, to be substantially forewardly-perpendicular to the back wall portion 520. Fold lines "$C_1$", "$D_1$" are substantially transverse to fold lines "$A_1$", "$A_2$", "$B_1$", "$B_2$" and are preferably collinear with first and second side edges 511, 513, respectively, of the planar blank 512.

Front side flaps 570, 575 form an integral construction with the front-wall portion 530 of the planar blank 512 and project transversely outwardly therefrom. The front side flaps 570, 575 are coplanar with the planar blank 512 and are inwardly foldable over fold lines "$C_2$" and "$D_2$", respectively, to be substantially forewardly-perpendicular to the front wall portion 530 and to overlap the forewardly-folded back side flaps 560, 565, respectively. The first planar surface 514 of each front side flap 570, 575 is adhesively securable to the second planar surface 516 of its respective back side flap 560, 565.

Figure 19:
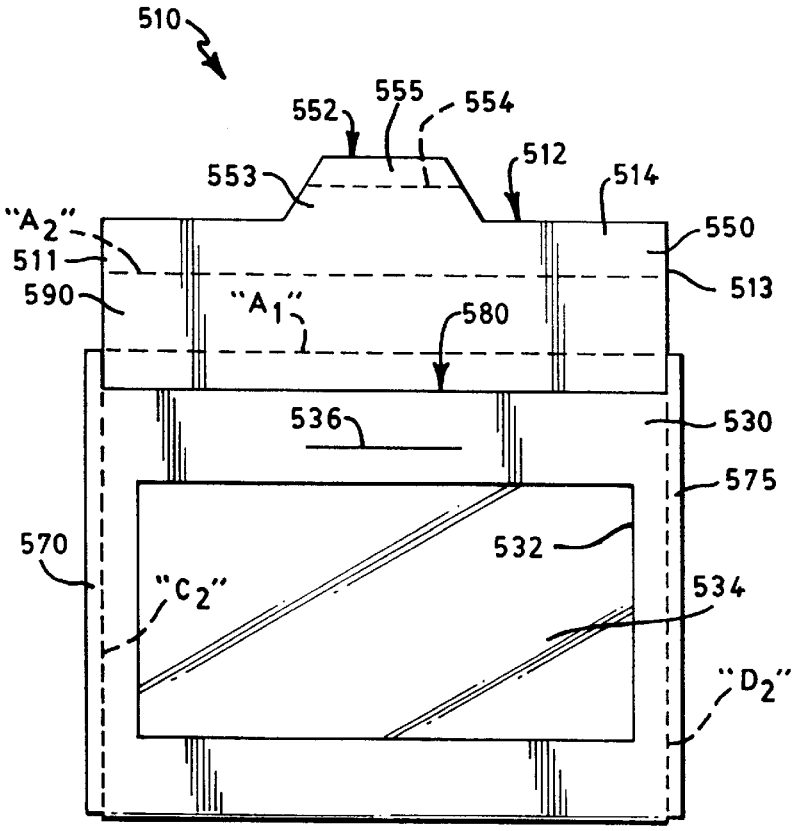
FIG. 19 is a front view of the planar blank of FIG. 17, shown partially folded to define a pocket for receiving advertising materials therein.
Figure 20:
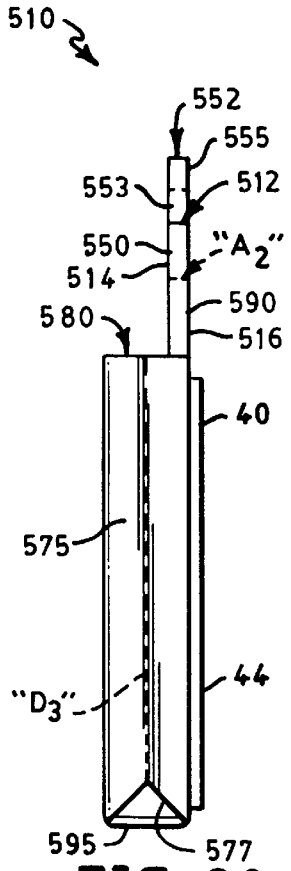
FIG. 20 is a side view of the planar blank of FIG. 19.

With additional reference to FIGS. 19 and 20, the planar blank 512 is foldable into the mailable advertising article 510 about fold lines"$A_1$", "$A_2$", "$B_1$", "$B_2$", "$C_1$", "$D_1$", "$C_2$", "$D_2$" to form a pocket 580 defined by the back wall portion 520, the front wall portion 530, the top portion 590, the bottom portion 595, the front side flaps 560, 565, and the back side flaps 570, 575. The pocket 580 is sized to receive at least one insert 585 therein, such as, for example, a coupon, letter, card, certificate, photograph or the like, which is viewable through the opening 532. Preferably, the pocket 580 is sized to receive a plurality of inserts 585 therein, and may contain one or more insert dividers **586*a*, 586*b*, 586*c* therein to permit categorizing the inserts 585 according to type. For example, if a plurality of coupon inserts 585 are provided, then one insert divider 586*a* may be provided for coupons relating to food articles, a second insert divider 586*b* may be provided for coupons relating to household supplies, a third insert divider 586*c* may be provided for coupons relating to children's items, and so on. Each insert divider 586*a*, 586*b*, 586*c*** may have a tabbed portion thereof to permit quick-access to coupons of a desired category.

More particularly, the pocket 580 is formed by folding the bottom portion 595 (and the front wall portion 530, which is substantially coplanar with the bottom portion 595) forewardly about fold line "$B_1$" so that the bottom portion 595 is substantially perpendicular to the back wall portion 520. The front wall portion 530 is folded upwardly about fold line "$B_2$" so that the front wall portion 530 is substantially parallel to the bottom portion 595, is spaced forewardly from the back wall portion 520 and is substantially parallel thereto, thereby defining a substantially "U"-shaped article, when viewed from the side. The back side flaps 560, 565 are each folded forewardly about fold lines "$C_1$", "$D_1$,", respectively, towards the front wall portion 530, but not more than half-way theretowards, so that the back side flaps 560, 565 are each perpendicular to the back wall portion 520. The front side flaps 570, 575 are each folded rearwardly about fold lines "$C_2$", "$D_2$", respectively, towards the back wall portion 520, and overlapping the back side flaps 560, 565, so that each front side flap 570, 575 is perpendicular to the front wall portion 530. The front planar surface 514 of each front side flap 570, 575 is adhesively affixable to the second planar surface 516 of its respective back side flap 560, 565.

Figure 21:
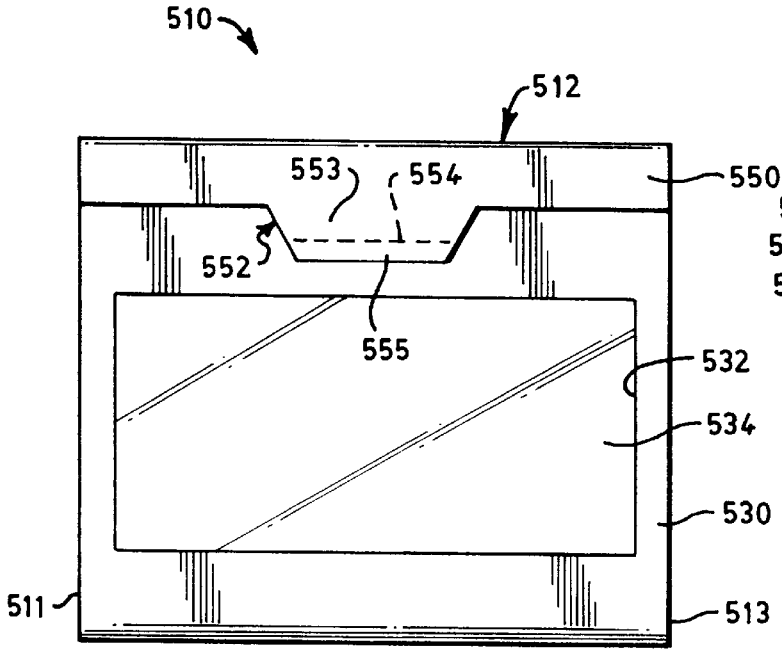
FIG. 21 is a front view of the planar blank of FIG. 17, shown completely folded to define the mailable advertising article.
Figure 22:
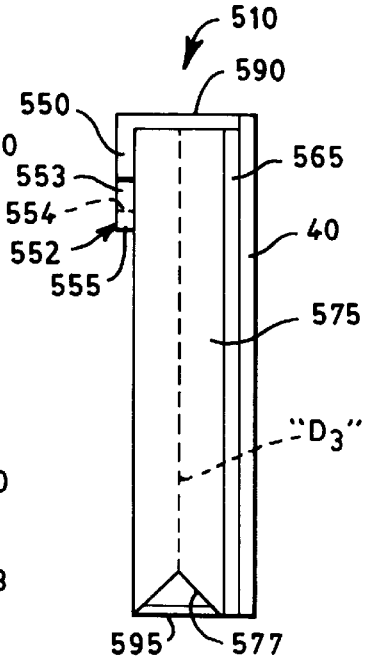
FIG. 22 is a side view of the completely-folded planar blank of FIG. 21.

With reference to FIGS. 21 and 22, the mailable advertising article 510 is folded into an orientation suitable for mailing as a first-class mail item with the USPS. More particularly, the top portion 590 (and the protective flap 550, which is substantially coplanar with the top portion 590) is folded forewardly about fold line "$A_1$" so that the top portion 590 is substantially perpendicular to the back wall portion 520, is spaced upwardly from the bottom portion 595 and is substantially parallel thereto. The protective flap 550 is folded downwardly about fold line "$A_2$" and over the second planar surface 516 of the front wall portion 530, thereby enclosing the at least one insert 595 and the one or more insert dividers 586*a*, 586*b* , 586*c* therein.

The protective flap 550 includes a tab portion 552 being substantially centered between the first and second side edges 511, 513, respectively, of the planar blank 512, and having a perforation line 554 thereacross, thereby defining a hold-down portion 555 and a free portion 553 of the tab 552. The first planar surface 514 of the hold-down portion 555 of the protective flap tab 552 is adhesively secured to the second planar surface 516 of the upwardly-folded front wall portion 530, by a line of adhesive (not shown), extending transversely thereacross.

To expose the pocket 580, for example, when an individual wishes to gain access to the at least one insert 585 therein, the individual grasps the protective flap 550, towards one side edge 511, 513 of the planar blank 512, and pulls the protective flap 550 upwardly away from the pocket-forming flap 530, to which the hold-down portion 555 of the protective flap tab 552 has been adhesively secured as described herein. The protective flap 550 is pulled with sufficient force to tear the tab 552 along the perforation line 554, thereby separating the free portion 553 of the tab 552 from the hold-down portion 555 thereof, which remains secured to the front wall portion 530. Lifting the protective flap 550 away from the pocket-forming flap 530, then, exposes the pocket 480, the at least one insert 585 held therein and the slit 536. The pocket 580 and the at least one insert 585 therein may be repeatedly concealed by closing the protective flap 550 and inserting the free portion 553 of the tab 552 into the slit 536, which has been sized and positioned to receive the free end 553 of the tab 552 and to affix the protective flap 550 to the front wall portion 530.

Either prior to, or after, opening of the article 510 as herein described, the article 510 may be magnetically secured to a magnetic surface, such as, for example, a mailbox, refrigerator, office desk, filing cabinet or the like, to display the foremost insert 585 disposed therein through the opening 532. After the article 510 has been opened, one or more of the at least one insert 585 may be removed and/or replaced within the pocket 580 and stored and displayed therefrom. Moreover, another item, such as a photograph, may be inserted into the pocket 580 and displayed by the article 510 from the magnetic surface. As such, the second planar surface 516 of the pocket-forming flap 530 may contain graphics or other indicia printed thereon, alongside the opening 432 to present the appearance of a picture frame, or the like.

With reference to FIGS. 24–27, the article 510 according to the present embodiment is collapsible to form a substantially-flat mailable article having advertising materials therein. The top portion 590 includes a fold line "$A_3$" thereacross, the bottom portion includes a fold line "$B_3$" thereacross and the front side flaps 570, 575 each include a fold line "$C_3$", "$D_3$", respectively, thereacross. Moreover, each front side portion 570, 575 includes a cut-out 572, 577, respectively, having substantially an inverted "V" shape. The thickness of the article 510, then, can be adjusted by squeezing the front wall portion 530 and the back wall portion 520 together, thereby causing the bottom portion 595 to fold upwardly as shown about the fold line "$B_3$" and causing the front side portions 570, 575 to fold inwardly as shown about respective fold lines "$C_3$", Alternatively, fold lines "$A_3$", "$B_3$", "$C_3$" and "$D_3$" may include a plurality of spaced, parallel accordion fold lines (not shown) which permit the article 510 to be squeezed together as described above, but wherein flaps 570, 575, 590 and 595 collapsibly fold in a zig-zag, accordion fashion.

With reference to FIGS. 28–32, a mailable advertising article 610 according to another alternative embodiment of the present invention includes many components in common with the article 310 according to the preferred embodiment hereof and like reference numerals are intended to represent like components. However, the article 610 according to the present embodiment is constructed from a planar blank 612 having a first planar surface 614 and a second planar surface 616. The planar blank 612 is formed from heavy-weight paper, Bristol board, paperboard or the like.

The planar blank 612 is divided by substantially parallel fold line "A", "B" to form a back wall portion 620, a coupon portion 630 and a greeting portion 640. More particularly, the first planar surface 614 of the coupon portion 530 is foldable upwardly about fold line "A" over the first planar surface 614 of the back wall portion 620 and adhesively secured thereto, for example, by a strip of adhesive (not shown) running along first and second side edges 611, 613, respectively, of the planar blank 612. The second planar surface 616 of the greeting portion 640 is folded downwardly about fold line "B" over the second planar surface 616 of the coupon portion 630 and adhesively secured thereto, for example, by a trip of adhesive (not shown) running along the first and second side edges 611, 613, respectively, of the planar blank 612. Alternatively, each strip of adhesive may be replaced with a dab of removable adhesive (not shown) to adhesively secure the portions 620, 630, 640 to one another in substantially a "Z"-shaped orientation described hereinabove. The magnetic sheet 40 is adhesively secured to the second planar surface 616 of the back wall portion 620 and includes mailing information, such as described hereinabove with respect to the preferred embodiment hereof, printed thereon.

Figure 32:
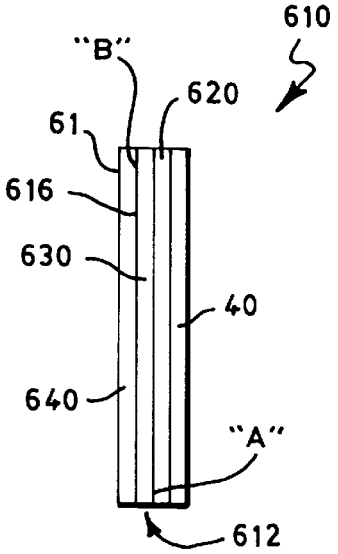

The first planar surface 614 of the greeting portion 640 includes text, graphics or other indicia printed thereon which greets a recipient thereof and is viewable by the recipient when the article 610 is magnetically affixed to a magnetic surface, for example, a mailbox, refrigerator, office desk, filing cabinet or the like, while the article is in the folded orientation shown in FIG. 32. The information contained on the first planar surface 614 of the greeting portion 640 does not direct the mailing of the article 610, such as does the information contained on the second planar surface 616 of the magnetic sheet 40, but rather, the information contained on the first planar surface 614 of the greeting portion 640 greets the recipient and conveys a general message thereto from the sender.

Figure 28:
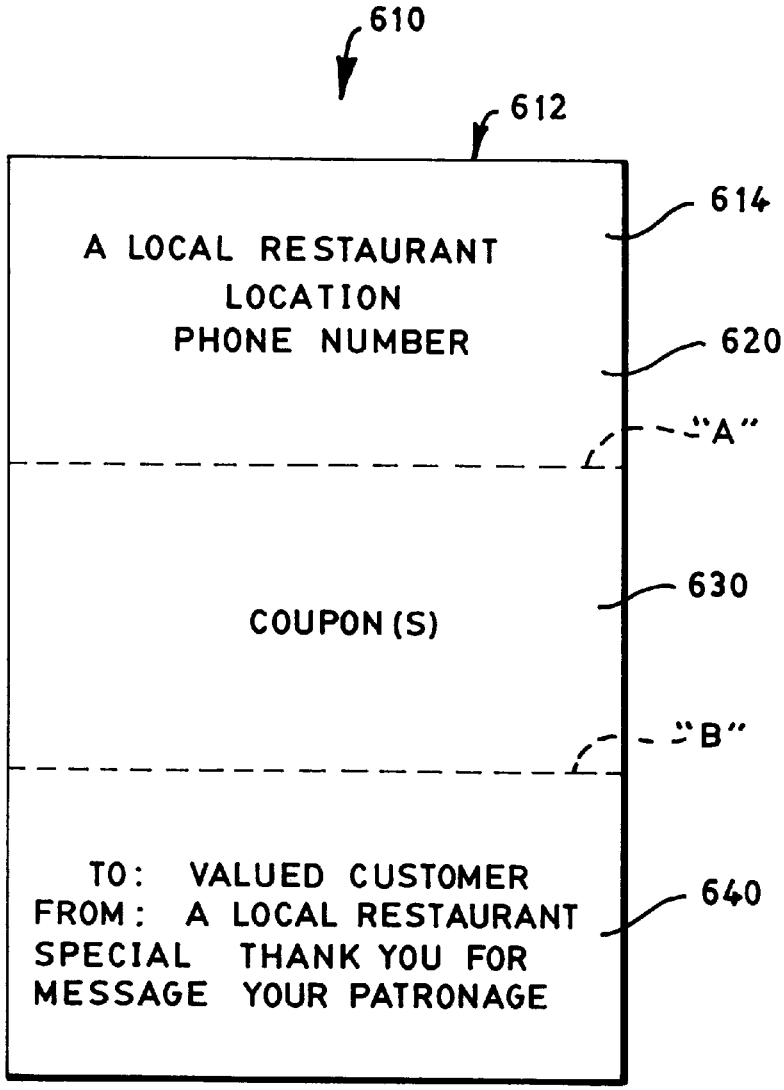
FIG. 28 is a front view of a planar blank being foldable to form a mailable advertising article according to another alternative embodiment of the present invention, showing the planar blank in an unfolded orientation.
Figure 29:
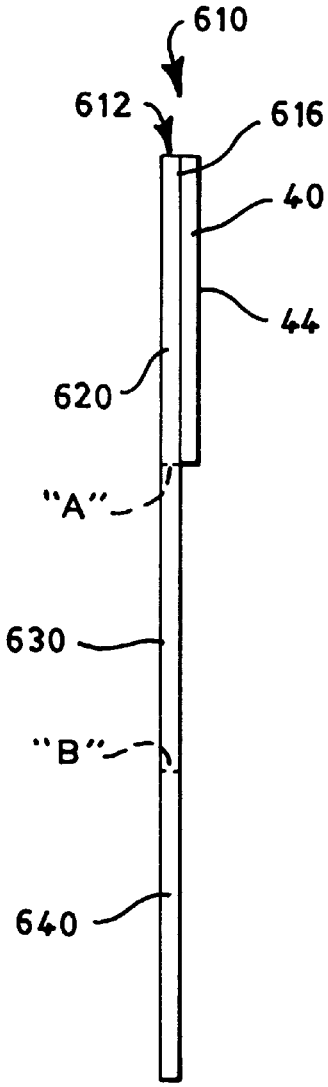
FIG. 29 is a side view of the planar blank of FIG. 28.
Figure 30:
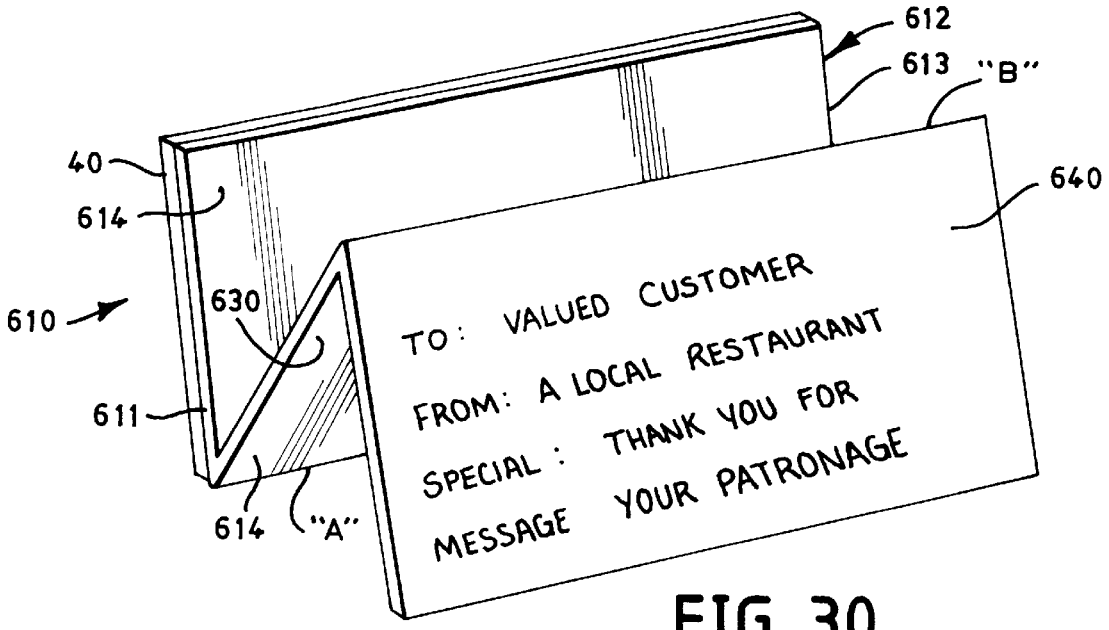
FIG. 30 is a perspective view of the planar blank of FIG. 28, shown in a partially-folded orientation.
Figure 31:
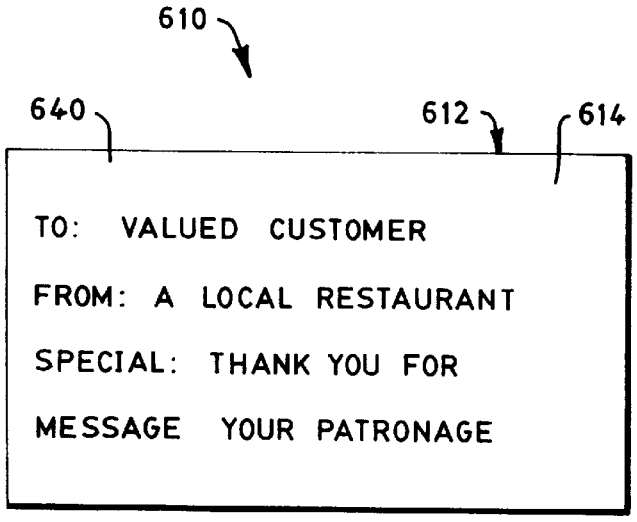
FIG. 31 is a front view of the planar blank of FIG. 28, shown in a folded orientation; and, FIG. 32 is a side view of the planar blank of FIG. 31.

The article 610 is displayable from the magnetic surface in either the folded orientation, such as is shown in FIG. 31, or in the unfolded orientation, such as is shown in FIG. 28. Moreover, the first planar surface 614 of the back wall portion 620 includes information, such as the sender's business name, telephone numbers and locations, printed thereon, which viewable when the article 610 is opened into the unfolded orientation, such as, by detaching the portions 620, 630, 640 from one another and removing the adhesive therefrom.

Upon opening the article 610 into the unfolded orientation, the coupon portion 630 is thereby exposed and displayable therefrom. In one embodiment of the present invention, fold lines "A" and "B" are perforation lines, along which the greeting portion 640 and the coupon portion 630 may each be individually removed from the back wall portion 620 and either discarded or redeemed. The coupon portion 630 may furthermore include one or more perforation lines (not shown) thereacross, thereby dividing the coupon portion into one or more individually-removable and redeemable coupons. The back wall portion 620 may remain affixed to the magnetic surface, even after detachment of the coupon portion 630 and the greeting portion therefrom, to provide a lasting advertisement.

Alternatively, the article 610 may be folded in a "roll-fold" orientation by folding the first planar surface 614 of the greeting portion 640 upwardly about fold line "B" over the first planar surface 614 of the coupon portion 630 and then folding the coupon portion 630 greeting portion 640 upwardly about fold line "A" such that the second planar surface 616 of the greeting portion 640 may be adhesively secured to the first planar surface 614 of the back wall portion 620.

Mailable advertising articles according to any one of the foregoing embodiments of the present invention enable a sender to use the USPS for bulk, direct-mailing of advertising materials and of other promotional articles, such as, for example, medicative pills, tablets or capsules, pillow-pack detergent samples or the like. Moreover, a mailable article provided according to any of the embodiments hereof are suitable for non-advertising use, such as, to send a personal greeting or the like.

Although the present invention has been described in terms of specific embodiments which are set forth in detail, it should be understood that this is by illustration only and that the present invention is not necessarily limited thereto, since alternative embodiments not described in detail herein will become apparent to those skilled in the art in view of the disclosure. Accordingly, modifications are contemplated which can be made without departing from either the spirit or the scope of the present invention as described hereinabove.

I claim:

1. A mailable advertising article, comprising:

a planar blank having first and second planar surfaces, and first and second fold lines dividing said planar blank into a back wall portion, a protective flap adjacent said back wall portion along said first fold line, and a pocket-forming flap adjacent said back wall portion along said second fold line; and, a magnetic sheet having a first planar surface and a second planar surface, said second planar surface of said back wall portion being placed over said first planar surface of said magnetic sheet; wherein, said pocket-forming flap is foldable about said second fold line over said back wall portion and is affixable thereto at at least one preselected location thereon, thereby forming a pocket between said back wall portion and said pocket-forming flap;

said protective flap is foldable about said first fold line over said pocket-forming flap and is affixable thereto at at least one preselected location thereon; and wherein, said second planar surface of said magnetic sheet includes mailing information thereon.

2. The mailable advertising article of claim 1, further comprising an opening provided in said pocket-forming flap.

3. The mailable advertising article of claim 2, further comprising a film affixed to said planar blank over said opening.

4. The mailable advertising article of claim 1, said protective flap having a tab projecting therefrom, said tab being affixable to said pocket-forming flap.

5. The mailable advertising article of claim 4, said tab having a tear line thereacross, said tear line dividing said tab into a hold-down portion and a retaining portion, said hold-down portion being affixable to said pocket-forming flap.

6. The mailable advertising article of claim 4, said pocket-forming flap having a slit therein for receiving said tab.

7. The mailable advertising article of claim 1, said back wall portion including at least one rear side flap extending outwardly therefrom, said at least one rear side flap being foldable thereover about a rear side flap fold line, said pocket-forming flap being affixable to said at least one rear side flap of said back wall portion.

8. The mailable advertising article of claim 7, said pocket-forming flap including at least one front side flap extending outwardly therefrom, said at least one front side flap being foldable thereover about a front side flap fold line, said at least one front side flap of said pocket-forming flap being affixable to said at east one rear side flap of said back wall portion.

9. The mailable advertising article of claim 8, said at least one front side flap having a fold line thereacross.

10. The mailable advertising article of claim 8, said at least one front side flap having a cut-out portion.

11. The mailable advertising article of claim 1, said pocket-forming flap having a bottom fold line thereacross, said bottom fold line being in spaced relation to said second fold line and dividing said pocket-forming flap into a bottom wall portion and a front wall portion.

12. The mailable advertising article of claim 11, said bottom wall portion having a fold line thereacross.

13. The mailable advertising article of claim 11, said protective flap having a top fold line thereacross, said top fold line being in spaced relation to said first fold line and dividing said protective flap into a top wall portion and a fold-over portion.

14. The mailable advertising article of claim 13, said top wall portion having a fold line thereacross.

15. The mailable advertising article of claim 1, further comprising an insert, said insert being receivable within said pocket.

* * * * *